US005557899A

United States Patent [19]

Dubé et al.

[11] Patent Number: 5,557,899

[45] Date of Patent: Sep. 24, 1996

[54] MODULAR ANTI-WARPING DOOR STRUCTURE

[75] Inventors: Pierre Dubé, St-Romuald; Barry Yane, Hampstead; Yvon Boudreau, Beaconsfield, all of Canada

[73] Assignee: Materiaux de Construction 2 Plus 2 Inc., Lachine, Canada

[21] Appl. No.: 375,773

[22] Filed: Jan. 20, 1995

[51] Int. Cl.[6] ..... E06B 3/70

[52] U.S. Cl. ..... 52/455; 52/456; 52/309.4; 52/309.9; 52/204.593; 52/204.71; 52/204.62; 49/DIG. 2

[58] Field of Search ..... 52/455, 456, 309.1, 52/309.4, 309.9, 309.14, 457, 458, 204.62, 204.67, 204.705, 208, 204.53, 204.54, 204.593, 204.71; 49/501, DIG. 2

[56] References Cited

U.S. PATENT DOCUMENTS

| | | | |
|---|---|---|---|
| 4,429,489 | 2/1984 | Pitt | 52/455 |
| 4,864,789 | 9/1989 | Thorn | 52/309.9 |
| 4,901,493 | 2/1990 | Thorn | 52/309.9 |
| 5,074,087 | 12/1991 | Green | 52/309.9 |
| 5,161,346 | 11/1992 | Olson et al. | 52/309.9 X |

FOREIGN PATENT DOCUMENTS 2913003 3/1979 Germany .

*Primary Examiner*—Kien T. Nguyen

[57] ABSTRACT

A modular anti-warping door panel for use in the construction of a door or door panels. The door panel comprises a rigid reinforcing frame constructed of material resistant to warping. The reinforcing frame is defined by two spaced apart elongated rigid members and one or more transverse spaced members. The reinforcing frame is retained in an elongated butte stile and a lock stile and a top and bottom rail. The stiles and rails are formed as hollow members of rectangular cross-section forming a peripheral panel frame. The two elongated rigid members are retained along an inner peripheral channel of the rectangular door frame. Panels are retained in an opening defined by the inner peripheral channel. A rigid post is secured in the butte and lock stiles along an outer edge portion thereof and concealed within the hollow stiles. A connecting element is disposed along an outer edge of the top and bottom rails and interconnected at opposed ends thereof with a top portion of the rigid post of the butte and lock stiles. The two elongated rigid members are received captive at opposed free ends thereof in the connecting element. An insulating rigid core material is disposed in inner spaces of the hollow stiles and rails.

20 Claims, 5 Drawing Sheets

MODULAR ANTI-WARPING DOOR STRUCTURE

TECHNICAL FIELD

The present invention relates to a modular anti-warp door panel incorporating therein a rigid reinforcing frame, preferably, but not exclusively, formed of steel, and wherein the stiles and the rails of the door are formed of extruded hollow boards filled with insulation and wherein securing posts are concealed within the outer edges of opposed stiles and interlocked by connecting key elements concealed within the top and bottom edge of the top and bottom rails.

BACKGROUND ART

A multitude of modular and composite thermally insulated door structures are known incorporating therein various compositions of materials primarily to provide a thermal barrier. When such doors have incorporated therein glass windows or thin panels, their structure is somewhat weakened and this will often cause the door to warp, and cause improper closing thereby causing air and water to infiltrate. U.S. Pat. No. 4,327,535 discloses the construction of a composite steel door incorporating a pane of glass which is surrounded by a mitered wooden frame and an interior foam core is disposed within opposed metal skins of the door. A top and bottom rail interlocks with the lock and hinge stiles which are fabricated of wooded boards. With this door structure the metal skins are secured to the stiles and rails, but there is no structural rigidity in between the stiles and rails, and the door is subject to warping along its longitudinal plane. A problem with using exposed indoor structures is that the steel will oxidate resulting in rust. Also, some door structures do not provide good insulation due to the fact that they utilize metal skins which are heat conductors and these skins contract and expand causing air and water leaks in areas where it is fastened or at joints.

It has now become customary to fabricate outside doors with plastic extruded material secured to wooden stiles and wherein a foam insulating material is injected within the door cavities. Such construction is, for example, illustrated in U.S. Pat. No. 5,074,087. A disadvantage of such door structures is that they exhibit weakness, particularly in the area where panels or glass panes are provided, and the door does not have rigidity in its longitudinal plane. Therefore, the door is apt to distort when the plastics material is subjected to heat and cold weather.

Many attempts have been made to construct reinforced domestic doors having a high resistance to warping, and this has led to complex door structures, with some such structures incorporating therein grids of reinforcing steel rods. These structures are very expensive and difficult to fabricate, and an example of such is disclosed in German Patent D2913003.

SUMMARY OF INVENTION

It is a feature of the present invention to provide a modular anti-warping door panel which is constructed from a combination of materials coacting and interconnected so as to provide a door structure having structural rigidity and which door is substantially warp free.

Another feature of the present invention is to provide a modular anti-warping door panel wherein the stiles and rails are extruded hollow plastic members which are foam-filled and wherein a structural steel frame is retained captive within an inner rectangular peripheral channel of the stiles and rails and further wherein decorative insulating panels or glass panes are secured, and still further wherein wooden posts are concealed along the outer edges of the opposed stiles and interlocked with a connecting key strip element which is concealed within a reinforcing connecting member in the top and bottom rails.

Another feature of the present invention is to provide a modular anti-warping door panel which is easy to assemble on site with precision and which provides structural rigidity to prevent warping while further providing a good thermal barrier.

According to the above features, from a broad aspect, the present invention provides a modular anti-warping door construction of a door or door panels. The door panel comprises a rigid reinforcing frame constructed of material resistant to warping. The reinforcing frame is defined by two spaced apart elongated rigid members and one or more transverse spaced members. The reinforcing frame is retained in an elongated butte stile and a lock stile and a top and bottom rail. The stiles and rails are formed as hollow members of rectangular cross-section forming a peripheral panel frame. The two elongated rigid members are retained along an inner peripheral channel of the rectangular door frame. Panels are retained in an opening defined by the inner peripheral channel. A rigid post is secured in the butte and lock stiles along an outer edge portion thereof and concealed within the hollow stiles. A connecting element is disposed along an outer edge of the top and bottom rails and interconnected at opposed ends thereof with a top portion of the rigid post of the butte and lock stiles. The two elongated rigid members are received captive at opposed free ends thereof in the connecting element. An insulating rigid core material is disposed in inner spaces of the hollow stiles and rails.

BRIEF DESCRIPTION OF DRAWINGS

A preferred embodiment of the present invention will now be described with reference to the accompanying drawings in which.

DESCRIPTION OF PREFERRED EMBODIMENTS

Figure 1A:
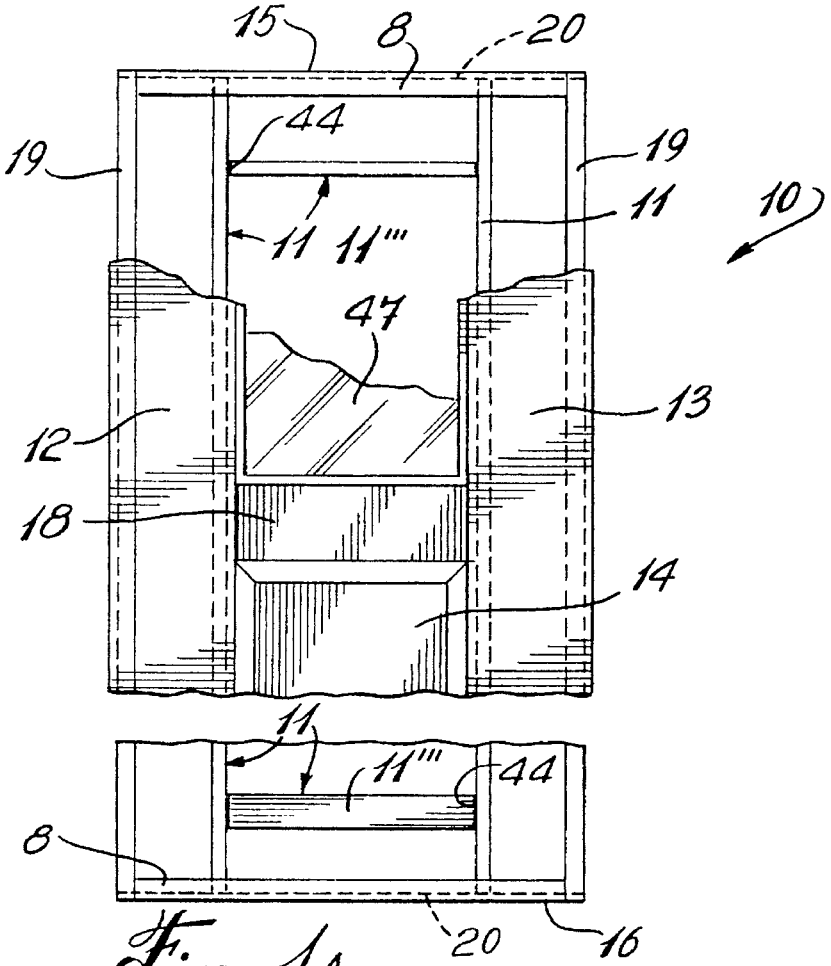
FIGS. 1A and 1B are plan views of a modular anti-warping door structure constructed in accordance with the present invention.
Figure 1B:
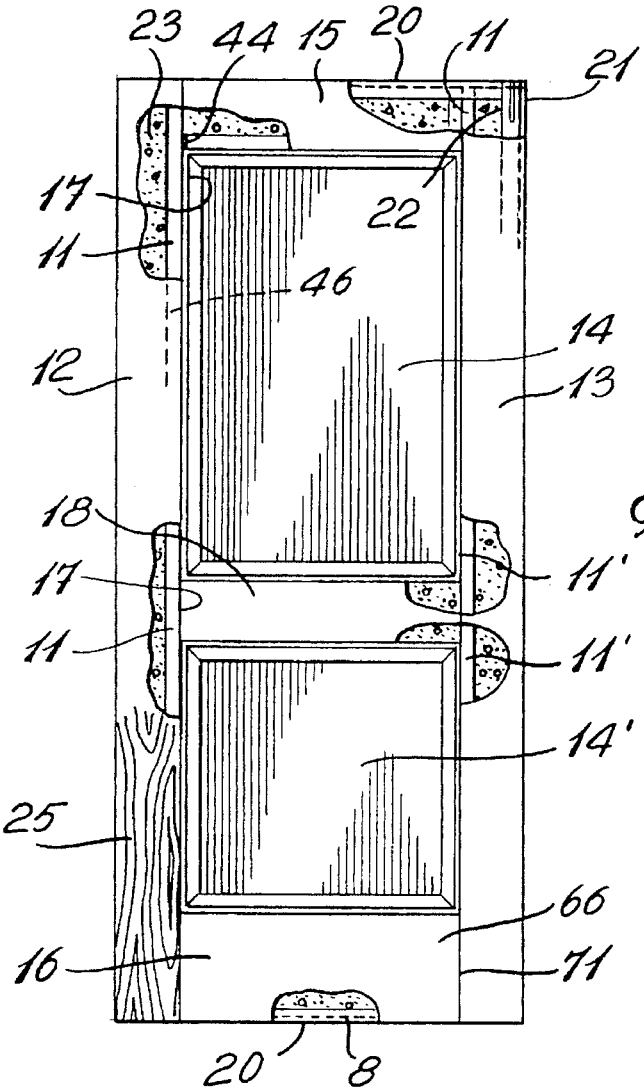

Referring to the drawings and more particularly to FIGS. 1A and 1B, there is shown generally at 10 a modular anti-warping door panel structure constructed in accordance with the present invention. The door panel structure 10 comprises a rigid rectangular reinforcing frame 11 constructed of material resistant to warping, herein steel, and held captive within a channel defined in an inner edge of plastic extruded door stiles, herein a butte stile 12 and a lock stile 13. The reinforcing frame 11 also extends within a like channel in the inner edges of a top rail 15 and a bottom rail 16. The opening 17 defined inside the frame 11 is adapted to retain one or more insulated door panels 14 and 14', or glass panes 47 (see FIG. 2). As herein shown, the door panels are separated by a center stile 18, however, a single glass pane may extend in the area of the opening 17.

A rigid wooden post 19 (FIG. 1A), of square cross-section, is secured in the butte and lock stiles 12 and 13 along an outer edge channel portion 9 (see FIG. 8) thereof to conceal the posts within the hollow stile members 12 and 13. A connecting key strip 20 is also concealed in a reinforcing connecting channel member 8 located in the top and bottom edges of the top and bottom rails 15 and 16 and interconnects with both ends 21 of the posts 19 by a fastener, herein a wooden dowel 22 (see FIG. 7A), to interconnect all the stiles 12 and 13 and the rails 15 and 16 about the frame 11. As is also shown in FIGS. 1A and 1B and with reference to FIGS. 7A and 7C, the reinforcing connecting channel member 8 is a wooden piece provided with cavities 7 in a lower wall 6 thereof to receive therein the free ends 11" of the steel tube 11 constituting the reinforcing frame. Accordingly, the frame is held secured at opposed ends thereof and also interlocked to the post 19 through the connecting key strip 20. The key strip 20 is also received in close fit within the channel 5 provided in the top wall 4 of the reinforcing channel member 6 and glued therein to provide a rigid interlocked door structure capable of resisting warping.

Figure 10A:
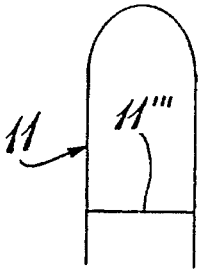
FIGS. 10A, 10B and 10C are illustrations of various shapes that the reinforcing frame may have.
Figure 10B:
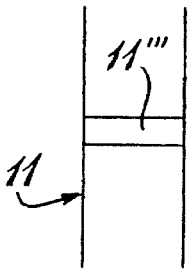
Figure 10C:
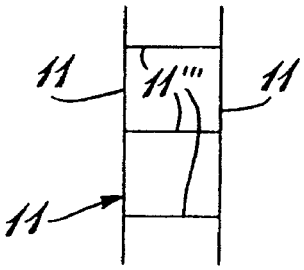

As shown in FIG. 1A and also in FIGS. 10A to 10C, there is provided at least one transverse member 11''' which is connected between two spaced parallel extending longitudinal structural members 11 and connected thereto by welding or bolts (not shown). As herein shown, one member 11''' is provided adjacent the top end and one adjacent the bottom end. If only a single member is provided, it should preferably be wider to give more structural rigidity to the frame and as shown with the member 11''' in the bottom end of the frame in FIG. 1A. These members provide resistance to torsion within the frame.

Figure 3:
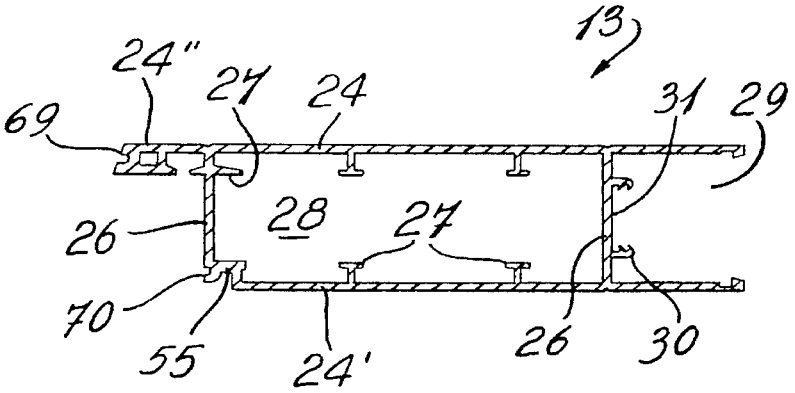
FIG. 3 is a section view of a plastic extruded stile member.
Figure 4:
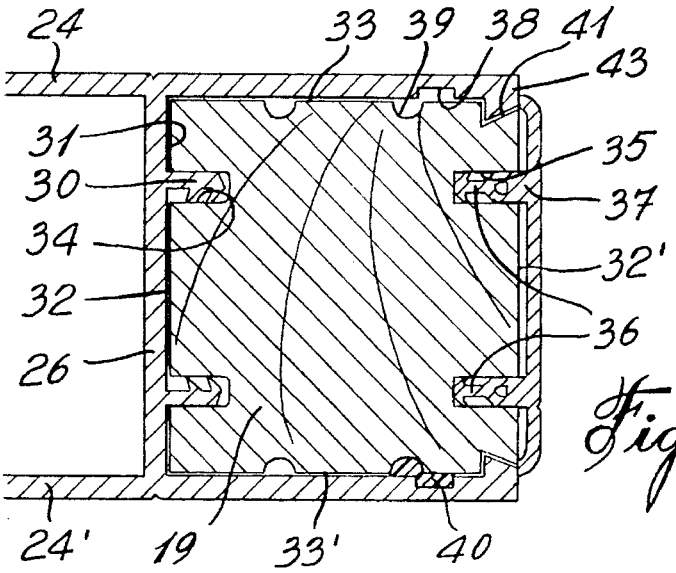
FIG. 4 is a section view showing the wooden post secured in the outer edges of the door stiles.
Figure 5:
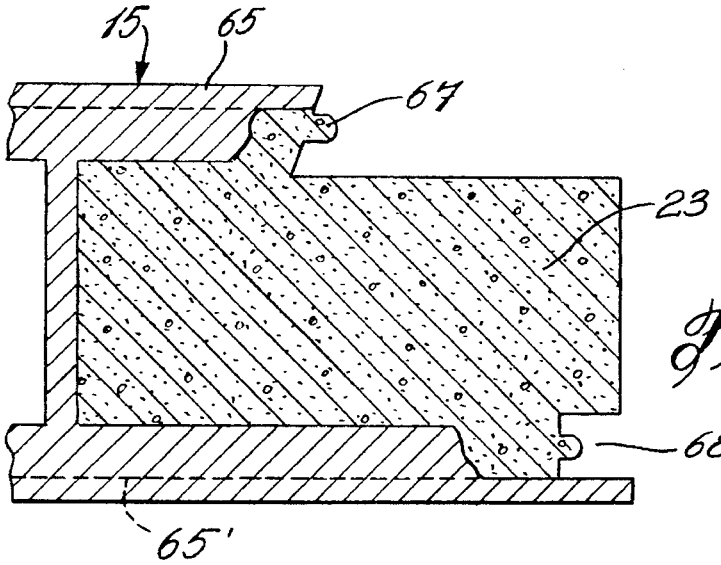
FIG. 5 is a section view showing the connecting ends of the rails which interconnect with the inner side edge of the door stiles.

An insulating rigid core material 23 is injected within the spaces provided in the door stiles and door rails, and this may be done after the door is assembled or prior to the door being assembled. Referring additionally to FIGS. 3 to 5, there is shown the construction of the plastic extruded butte and lock stiles 12 and 13 and rails 15 and 16. They are formed as hollow extruded rectangular members having opposed parallel-spaced flat panels 24 and 24' which may have a wood texture 25 molded on or applied to the outer face thereof. These panels 24 and 24' are interconnected by transverse webs 26 may and have internal attaching ribs 27. The insulating foam material 23 is injected within the space 28 and solidifies therein and interlocks with the attaching ribs 27 to maintain the panels 24 and 24' securely interconnected parallel to one another and non-thermally conductive.

It is pointed out that the butte and lock stiles are identically formed and each have an open-ended trough or channel 29 defined along an outside edge thereof for receiving a post 19 captive therein by the provision of one or more elongated retention ribs 30 which protrude from a bottom wall 31 of the trough 29 in the direction of the open end of the trough.

As shown in FIG. 4, the wooden post 19 is provided with opposed pairs of parallel flat walls 32 and 32', and 33 and 33'. One of the opposed parallel flat walls, herein inner wall 32, is provided with one or more connecting grooves 34 therein to receive the one or more retention ribs 30 in frictional connecting engagement therein to retain the post 19 within the trough 29.

As herein shown, the opposed one of the parallel flat walls 32' of the post is also provided with connecting grooves 35 to receive connector posts or ribs 36 of an edge molding 37 also extruded or injected from plastics material. Accordingly, the wooden post 19 is completely retained and concealed within a channel or through in the outer edge of the extruded door stiles. The narrow channels 38 formed in the inner face of the panels 24 and 24', mate with one of the channels 39 cut into the opposed panel flat walls 33 and 33' of the post whereby silicone 40 may be injected therein to form a thermal barrier and to further immovably secure the post within the open-ended trough 29.

Figure 8:
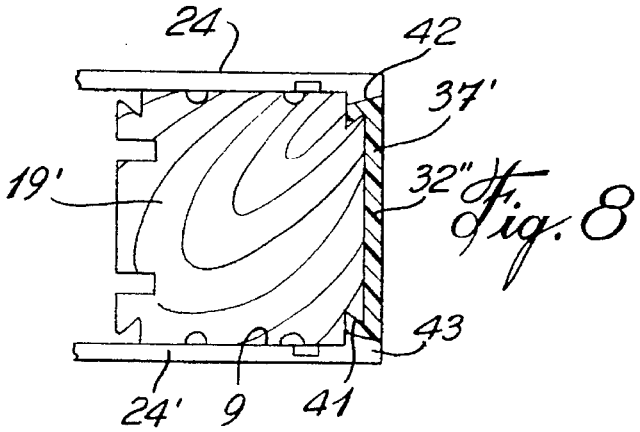
FIG. 8 is a section view similar to FIG. 4 but showing a modification thereto.

As shown in FIG. 8, the post 19' has an outer parallel flat wall 32" which is formed differently from the post 19 and, as herein shown, is provided with opposed undercut edge channels 41 to receive therein the end flanges 42 of an flush edge molding 37' as well as the retention rib 43 formed in the end edge of the opposed panels 24 and 24'. Accordingly, the edge molding 37' is recessed between the end edge of the door to protect same and to provide a smooth flush door edge.

Figure 2:
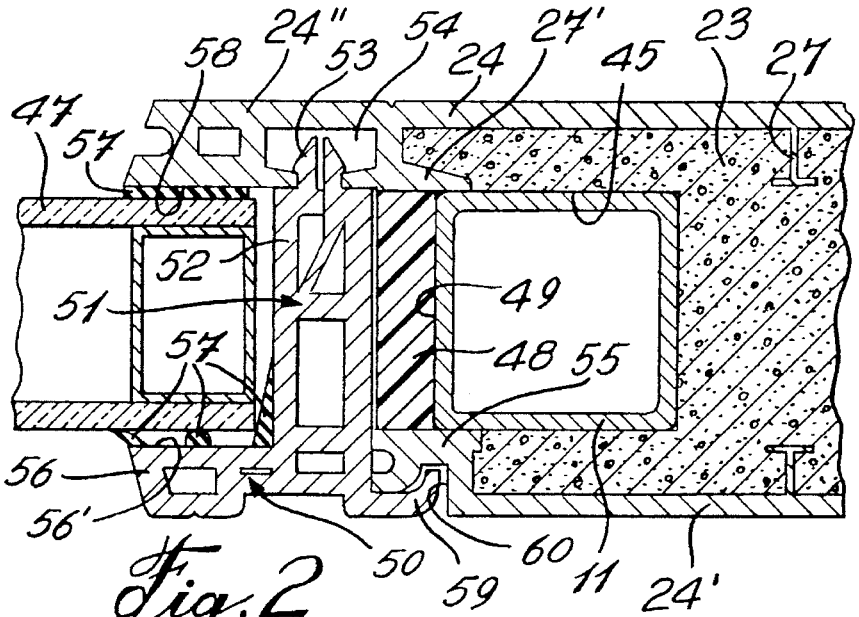
FIG. 2 is a fragmented cross-section view showing the location of the reinforcing frame within the extruded plastics stile board filled with a rigid insulating foam and wherein a glass pane is secured in a door fabricated with the frame.

As shown in FIG. 2, the rigid rectangular reinforcing frame 11 is herein shown as a hollow tubular steel frame of square cross-section and formed of straight tubular members with the transverse members 11''' welded together at their ends, as shown at 44 in FIGS. 1A and 1B. The frame 11 is retained concealed within an inner peripheral channel 45 formed in the inner rectangular peripheral portion 46 of the rectangular door frame between the parallel spaced flat walls 24 and 24'. This channel is preformed in the insulating foam material 23, or could be molded of plastic. As herein shown, the wall 24 is provided with an extension flange portion 24" which extends beyond the opening of the inner peripheral channel 45 for abutment retention with the panel 14 or a glass thermo pane 47, as herein shown. A seal tape or strip 48 of insulated foam material is adhered on the outer wall 49 of the reinforcing frame 11 to provide an insulation on that wall whereby the metal frame is completely isolated within the stiles and rails by non-thermally conductive materials.

A flange connector strip 50 is provided to sealingly interlock the thermo pane 47 or door panels 14 within the opening of the door structure inside the frame 11. This flange connector 50 has a connecting extension portion 51 comprised of a transverse bridge wall 52 provided with a connector head 53 at a free end thereof to engage in a coacting connector channel 54 formed on the back surface of the end flange portion 24". The bridge wall 52 spans the opening formed between the inner surfaces of the ribs 27' and 55 to provide a further seal barrier and to add structural rigidity across the channel 45 opening.

The flange connector 50 also has a flange portion 56 which extends in parallel facial and spaced relationship with the extension portion 24" disposed adjacent the thermo pane 47 for clamping retention of a peripheral portion of the pane between the extension flange portion 24" and the flange portion 56. Appropriate seals 57 are secured to the inner face 56' of the flange 56 and the inner face 58 of the extension flange 24' to seal the thermo pane within the channel formed between the extension flange portion 24" and the flange connector 56 and the transverse bridge wall 52.

The flange connector 50 is also provided with a hook extension edge 59 which is engageably received in an edge slot 60 of the flat panel 24' for snap engagement therein. As can be seen the opposed panels 24 and 24' are maintained in flat parallel planes by rigid foam 23.

Figure 6:
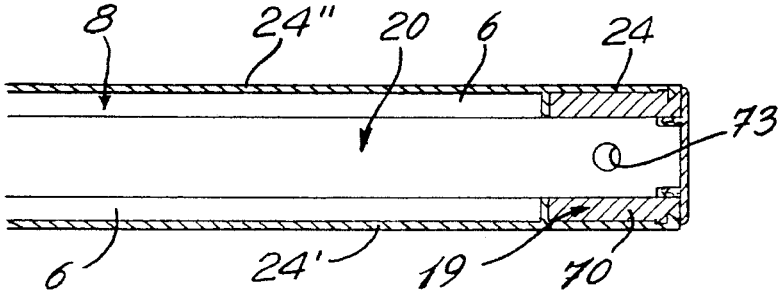
FIG. 6 is a section view showing the connecting key strip element interlocking the door posts at their outer end.
Figure 7A:
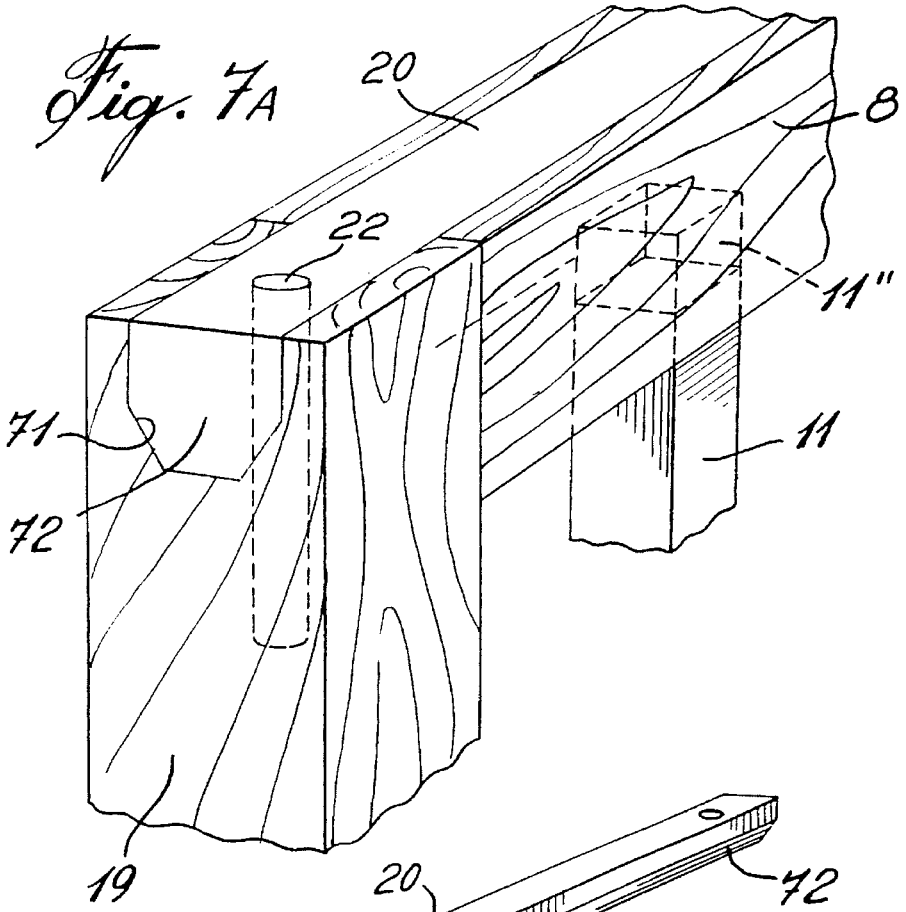
FIG. 7A is a fragmented perspective view showing the key element interlocked with the corner posts.
Figure 7B:
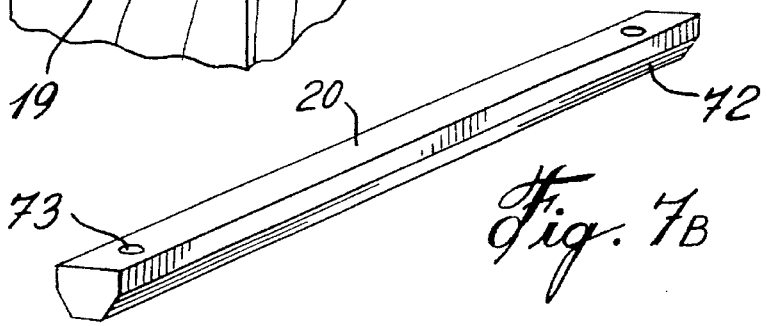
FIG. 7B is a perspective view of the connecting key strip element.
Figure 7C:
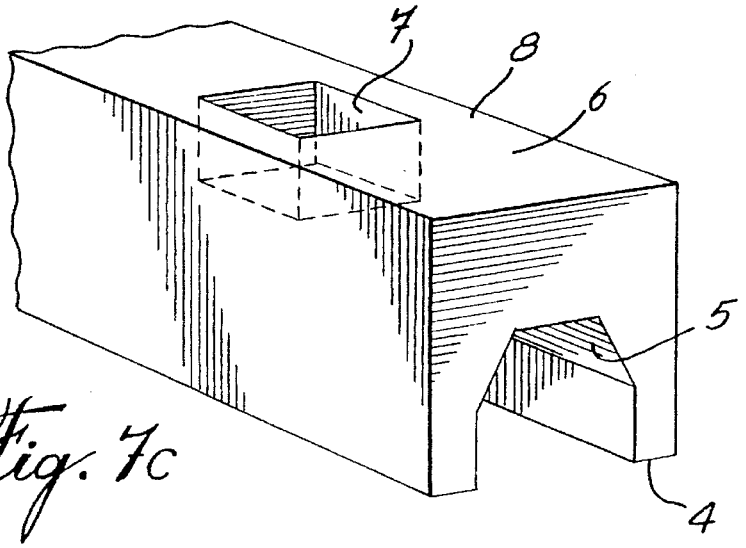
FIG. 7C is a perspective fragmented bottom view of the reinforcing channel member.
Figure 9:
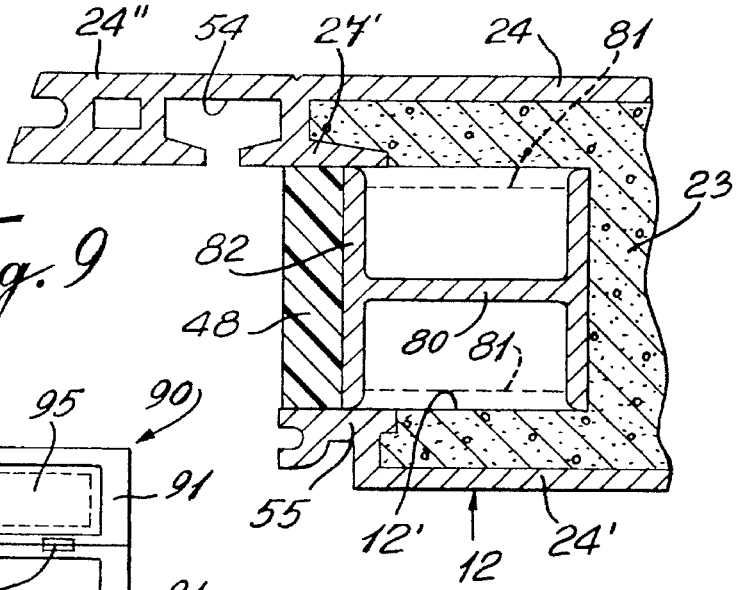
FIG. 9 is a view similar to FIG. 2 but showing the reinforcing frame constructed from a small steel H or C rod.

Referring now to FIG. 5, there is shown the construction of the top and bottom rails 15 and 16 and they also consist of extruded hollow plastic boards having opposed panels 65 and 65' filled with a rigid insulating foam material 23. However, as herein shown, the end portion 66 of these boards are formed with tongue and groove connectors 67 and 68 molded in the foam to be received in mating relationship with the groove connector 69 and tongue connector 70 formed in the free end of the extension flange portion 24" and the rib 55, as shown in FIGS. 3 and 9. These groove connectors 67 and 68 are offset so as to provide a rigid connection across the joint 71 (see FIG. 1) and better thermal insulation. The butte and lock stiles 12 and 13, and the top and bottom rails 15 and 16, are also held together in alignment at their mating joints by a connecting key strip 20, as shown in FIGS. 6 and 7A, which is held recessed within the channel 5 of the connecting element 8 located in the hollow outer edges of the top and bottom rails, as shown in FIGS. 1A and 1B. This connecting key strip 20 extends over outer ends 70 of the wooden posts 19 which are formed with a cavity 71 wherein to receive the tapered lower end section 72 of the connecting key strip 20. A transverse hole 73 is provided at the end of the connecting key strip 20 to receive a wooden dowel 22 therein to interlock the connecting key strip with the ends of the posts 19 so that the rails and stiles are interlocked together between the reinforced frame 11, the posts and the connecting strips 20.

Although the reinforcing frame 11 is shown FIG. 2 as being a hollow square steel channel, it could be made of any suitable rigid material and, as shown in FIG. 9, this frame may be made from a steel H-rod 80, or it may be a U-shaped channel, as shown in phantom lines at 81 with the bridge wall 82 of the channel being disposed across the opening between the ribs 27' and 55. It could also conceivably be a member of circular cross-section.

Referring now to FIGS. 10A, 10B and 10C, there are shown various configurations that the frame 11 may have and a multitude of other configurations are foreseen. As shown in FIG. 10A, the frame may be formed of a tubular U-shaped member having a transverse member 11"' connected adjacent the lower end thereof. That member could also be a wide transverse member, as shown in FIG. 10B where the frame is formed as an H-frame. In FIG. 10C there is shown three transverse spaced members 11"' disposed between the side members 11 to provide added rigidity to the frame. Panels or windows could be disposed in the rectangular openings between the transverse members after the stiles and rails are installed, etc.

Figure 11:
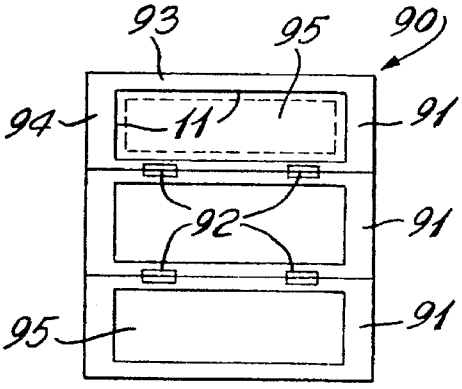
FIG. 11 is a simplified view showing a three-panel garage door constructed from anti-warping door panels of the present invention.

FIG. 11 shows the construction of a garage door 90 formed from three panels 91, each panel having therein a frame 11 consisting of parallel side frame members and transverse frame members. The panels 91 are interconnected by suitable hinges, such as those shown at 92, to prevent the door to fold. The frame 11 would be concealed within 93 and rails 94, as shown in phantom lines, and the panel 95 would be secured within the frame opening. In conclusion, it can be seen that the modular anti-warping door panel of the present invention has great versatility and may be incorporated in all types of doors and windows having different shapes.

It is therefore within the ambit of the present invention to cover any other obvious modifications provided such modifications fall within the scope of the appended claims.

We claim:

1. A modular anti-warping door panel for use in the construction of a door or door panels, said panel comprising a rigid reinforcing frame constructed of material resistant to warping, said reinforcing frame being defined by two spaced apart elongated rigid members and one or more transverse members, said reinforcing frame being secured between an elongated butte stile and a lock stile and a top and bottom rail, said stiles and rails being formed as hollow members of rectangular cross-section forming a peripheral panel frame, said two elongated rigid members being retained along an inner peripheral channel of said butte stile and lock stile, panel means retained in an opening defined by said inner peripheral channel, a rigid post secured in said butte and lock stiles along an outer edge portion thereof and concealed within said hollow stiles, a connecting element disposed along an outer edge of said top and bottom rails and interconnected at opposed ends thereof with a top portion of said rigid post of said butte and lock stiles, said two elongated rigid members being received captive at opposed free ends thereof in said connecting element, and an insulating material disposed in inner spaces of said butte and lock stiles and said top and bottom rails.

2. A modular door panel as claimed in claim 1 wherein said stiles and rails are plastic extruded rectangular hollow members having opposed parallel-spaced flat panels interconnected by transverse webs, said butte and lock stile channels having an open ended trough defined along an outside edge thereof for receiving said post captive therein.

3. A modular door panel as claimed in claim 2 wherein said post is a wooden post having opposed parallel flat walls.

4. A modular door panel as claimed in claim 3 wherein said trough has a bottom wall formed by one of said webs, one or more retention ribs protruding from said bottom wall and extending in the direction of said open end of said trough, said wooden post having one or more connecting grooves means in one of said flat walls to receive said one or more retention ribs in frictional connecting engagement therein to retain said post in said trough.

5. A modular door panel as claimed in claim 4 wherein an edge molding is connected over an outer one of said flat walls of said post and having an outer face disposed flush with outer end edges of said flat panels on opposed sides of said open ended trough.

6. A modular door panel as claimed in claim 2 wherein said connecting element is comprised of a reinforcing channel member having a channel along an outer surface thereof for receiving an elongated connecting key strip therein, a pair of spaced apart bores in an inner surface of said channel member for receiving said free ends of said two elongated members in tight fit therein, said reinforcing channel member abutting at opposed ends against a respective one of said rigid post secured in said butte and lock, said connecting key strip extending in a channel formed at a free end of said rigid post and secured thereto by a fastener means.

7. A modular door panel as claimed in claim 6 wherein an elongated connecting key strip and reinforcing channel member are constructed of wood, and means to immovably secure said key in said channel of said reinforcing channel member.

8. A modular door panel as claimed in claim 7 wherein said fastener means is a wood dowel.

9. A modular door panel as claimed in claim 7 wherein said elongated connecting key strip is an elongated wood strip having a flat top wall and wedge shaped side walls, said wood strip extending in a like shaped cavity forming said channel in said outer surface of said reinforcing channel member.

10. A modular door panel as claimed in claim 2 wherein an outer one of said flat panels has an extension flange portion extending beyond an opening of said inner peripheral channel for abutment retention of said panel means thereagainst, and a flange connector having a connecting extension portion for securing a flange portion thereof in facial relationship and spaced parallel from said extension portion and disposed adjacent said other of said flat panels for clamping retention of a peripheral portion of said panel between said extension flange portion and said connecting extension portion.

11. A modular door panel as claimed in claim 10 wherein said flange connector has a hook edge received in an edge slot of said other of said flat panels, said connecting portion being comprised of a transverse bridge wall having a connector head at a free end to engage in a coacting connector channel formed in a rear wall of said extension flange portion, said bridge wall spanning said opening of said inner peripheral channel.

12. A modular door panel as claimed in claim 11 wherein a sealing strip is disposed between an outer face of said frame and said bridge wall.

13. A modular door structure as claimed in claim 2 wherein said insulating material is a rigid core foam insulating material disposed within said rectangular hollow members.

14. A modular door panel as claimed in claim 2 wherein said rectangular hollow members forming said top and bottom rails are provided with a rigid foam core, said rigid foam core having connectors formed at opposed ends of said core for mating engagement with a connecting inner free edge of extension flanges of said butte and lock stiles.

15. A modular door panel as claimed in claim 2 wherein said modular door panel is a door.

16. A modular door panel as claimed in claim 1 wherein said panel means is a glass panel.

17. A modular door panel as claimed in claim 1 wherein said panel means is a solid door panel.

18. A modular door panel as claimed in claim 1 wherein said rigid reinforcing frame is a steel frame formed of hollow tubes of substantially square cross-section.

19. A modular door panel as claimed in claim 1 wherein said rigid reinforcing frame is a steel frame formed of U or H-rods welded at their ends to form said rectangular frame.

20. A modular door panel as claimed in claim 1 wherein there are two of said transverse spaced members interconnected between said two elongated rigid members and spaced respectively from opposed ends of said rigid members.

* * * * *